US010461453B2

(12) United States Patent
Liu et al.

(10) Patent No.: US 10,461,453 B2
(45) Date of Patent: Oct. 29, 2019

(54) POWER PLUG AND SOCKET

(71) Applicant: WELL SHIN ELECTRONIC (KUNSHAN) CO., LTD., Jinxi Town, Kunshan, Jiangsu (CN)

(72) Inventors: Jixue Liu, Jiangsu (CN); Xuejuan Zhao, Jiangsu (CN)

(73) Assignee: WELLS SHIN ELECTRONIC (KUNSHAN) CO., LTD., Jiangsu (CN)

( * ) Notice: Subject to any disclaimer, the term of this patent is extended or adjusted under 35 U.S.C. 154(b) by 0 days.

(21) Appl. No.: 15/773,475

(22) PCT Filed: Feb. 15, 2017

(86) PCT No.: PCT/CN2017/073564
§ 371 (c)(1),
(2) Date: May 3, 2018

(87) PCT Pub. No.: WO2018/068453
PCT Pub. Date: Apr. 19, 2018

(65) Prior Publication Data

US 2018/0337478 A1 Nov. 22, 2018

(30) Foreign Application Priority Data

Oct. 12, 2016 (CN) ..... 2016 1 0888819

(51) Int. Cl.
*H01R 13/05* (2006.01)
*H01R 13/10* (2006.01)
(Continued)

(52) U.S. Cl.
CPC ..... *H01R 13/05* (2013.01); *H01R 13/10* (2013.01); *H01R 13/35* (2013.01);
(Continued)

(58) Field of Classification Search
CPC ..... H01R 13/05
See application file for complete search history.

(56) References Cited

U.S. PATENT DOCUMENTS 5,095,259 A 3/1992 Bailey et al.
2002/0070702 A1* 6/2002 Ragnarsson ..... H02J 7/0045 320/101
(Continued)

FOREIGN PATENT DOCUMENTS

CN 2446684 Y 9/2001
CN 1794520 A 6/2006
(Continued)

OTHER PUBLICATIONS

Chinese Office Action, dated Mar. 26, 2018, for Chinese application No. 201610888819.5.

*Primary Examiner* — Ross N Gushi
(74) *Attorney, Agent, or Firm* — Miles & Stockbridge, P.C.; David R. Schaffer

(57) ABSTRACT

The present disclosure relates to techniques of electronic components and, for example, to a power plug and socket. A power plug and a power socket working together with each other are provided. The power plug includes a body, at least two AC plug terminals fixed inside the body, and two DC plug terminals fixed inside the body. Each of the AC plug terminals and each of the DC plug terminals are respectively connected to separate connecting wires. The power socket includes a base. The base is provided with a base cavity. Shape of the base cavity is adapted to shape of an insert end of the body. The base cavity is provided with AC socket terminals corresponding to the AC plug terminals one by one and DC socket terminals corresponding to the DC plug terminals one by one.

8 Claims, 6 Drawing Sheets

(51) Int. Cl.

| | |
|---|---|
| ***H01R 13/35*** | (2006.01) |
| ***H01R 13/66*** | (2006.01) |
| ***H01R 24/76*** | (2011.01) |
| ***H01R 24/28*** | (2011.01) |
| ***H01R 27/00*** | (2006.01) |
| *H01R 103/00* | (2006.01) |

(52) U.S. Cl.
CPC ..... *H01R 13/6675* (2013.01); *H01R 24/28* (2013.01); *H01R 24/76* (2013.01); *H01R 27/00* (2013.01); *H01R 2103/00* (2013.01)

(56) References Cited

U.S. PATENT DOCUMENTS

| | | | | |
|---|---|---|---|---|
| 2002/0137382 | A1* | 9/2002 | Shirakura ..... | H01R 31/06 439/218 |
| 2005/0153588 | A1 | 7/2005 | Liao | |
| 2006/0172609 | A1* | 8/2006 | Wang ..... | H01R 13/405 439/680 |
| 2007/0202724 | A1 | 8/2007 | Neumann | |

FOREIGN PATENT DOCUMENTS

| | | | |
|---|---|---|---|
| CN | 205509184 | U | 8/2016 |
| CN | 206098823 | U | 4/2017 |
| JP | H0554935 | A | 3/1993 |

* cited by examiner

POWER PLUG AND SOCKET

CROSS REFERENCE TO RELATED APPLICATIONS

This application claims the benefit of PCT Application No. PCT/CN2017/073564, filed Feb. 15, 2017, now pending, which claims the benefit of and priority to Chinese Patent Application No. 201610888819.5, filed Oct. 12, 2016, all of which are incorporated herein by reference in their entireties.

TECHNICAL FIELD

The present disclosure relates to techniques of electronic components and, for example, to a power plug and socket.

BACKGROUND

A plug and a socket are conductive when supplied with single-frequency Alternating Current (AC) power. Once the AC power is cut off, an electrical device stops working due to a non-conductive circuit. On the one hand, a power outage may damage components inside the electrical device; on the other hand, the power outage affects normal running of the electrical device. For an electrical device used on an important occasion, a shutdown causes unnecessary economic losses and may, if serious, threaten safety of a user. Therefore, it is needed to provide a power plug and socket to ensure normal running of an electrical device after AC power is cut off.

SUMMARY

The present disclosure provides a power plug and a power socket working together with the power plug to alleviate a phenomenon where an electrical device stops working due to an AC power outage.

A power plug includes a body, at least two AC plug terminals fixed inside the body, and two Direct Current (DC) plug terminals fixed inside the body, where each of the AC plug terminals and each of the DC plug terminals are respectively connected to separate connecting wires.

As an optional solution of the power plug, the body includes a first body and a second body, where the first body and the second body are adaptively joined to each other to form a plurality of mounting structures, and each of the AC plug terminals and each of the DC plug terminals are respectively fixed inside different mounting structures.

As an optional solution of the power plug, a cavity is provided inside the first body and is configured to accommodate a part of the second body.

As an optional solution of the power plug, a cavity is provided inside the first body and is configured to accommodate a whole of the second body.

As an optional solution of the power plug, at least two mounting holes are provided inside the second body, one of the AC plug terminal is fixed inside each of the mounting holes, two mounting slots are provided on a surface of the second body, and one of the DC plug terminal is fixed inside each of the mounting slots.

As an optional solution of the power plug, slots are provided along a depth direction on hole walls of the mounting holes, a first flexible claw and a second flexible claw are provided on the AC plug terminals, and the first flexible claw and the second flexible claw are flexibly joined to and pressed against the slots respectively.

As an optional solution of the power plug, a mounting notch is provided on a side wall of the mounting slot, and a protrusion is provided on the DC plug terminal and is clamped in the mounting notch.

As an optional solution of the power plug, the power plug further includes an end cap clamped to an end of the first body, where a communicating pore is provided on the end cap, and an end of the second body passes through the end cap via the communicating pore.

A power socket, which works together with the above-mentioned power plug, includes a base, where the base is provided with a base cavity, shape of the base cavity is adapted to shape of an insert end of the body, and the base cavity is provided with AC socket terminals corresponding to the AC plug terminals one by one and DC socket terminals corresponding to the DC plug terminals one by one.

As an optional solution of the power socket, at least two of the AC socket terminals are fixedly mounted to a back of the base, and a first end of each AC socket terminal is disposed inside the base cavity and a second end of each AC socket terminal extends out of the base.

As an optional solution of the power socket, two DC socket terminals are respectively clamped to inner side walls of the base by clamping slots, and a first end of each DC socket terminal is disposed inside the base cavity and a second end of each DC socket terminal extends out of the base.

In the present disclosure, two DC plug terminals are added to a power plug and two DC socket terminals are added to a power socket, and the power plug and the power socket work together with each other, so that after AC power to which an electrical device is connected is cut off, the electrical device can be connected to a storage battery or another device that provides DC power to the electrical device, and thereby the electrical device can run normally after the AC power is cut off.

BRIEF DESCRIPTION OF DRAWINGS

To illustrate solutions in embodiments of the present disclosure more clearly, the accompanying drawings used in description of embodiments of the present disclosure will be described below. Apparently, the accompanying drawings described below illustrate part of embodiments of the present disclosure and those skilled in the art may obtain other accompanying drawings based on embodiments of the present disclosure and the accompanying drawings.

REFERENCE SIGNS

101: Body; 102: L plug terminal; 103: N plug terminal; 104: Positive DC plug terminal; 105: Negative DC plug terminal; 106: First body; 107: Second body; 108: End cap; 109: Conducting wire;

1021: First flexible claw; 1022: Second flexible claw; 1031: First flexible claw; 1032: Second flexible claw; 1041: First protrusion; 1051: Second protrusion; 1071: Mounting hole; 1072: Mounting slot; 1073: Slot; 1074: Mounting notch; 1081: Communicating pore;

201: Base; 202: Base cavity; 203: L socket terminal; 204: N socket terminal; 205: Positive DC socket terminal; 206: Negative DC socket terminal; 207: First connecting terminal; 208: Second connecting terminal;

2011: Upper base cover; 2012: Lower base cover.

DETAILED DESCRIPTION

The solutions of the present disclosure will be described below in conjunction with the accompanying drawings and specific embodiments from which these solutions will be apparent to those skilled in the art. If not in collision, the following embodiments and the features thereof may be combined with each other.

In the present disclosure, the working principle of a power plug and a power socket working together with each other is as follows: when an electrical device is connected to AC power and is in a normal working state, a set of DC terminals provided on the power plug and the power socket are non-conductive between each other, and the AC power can ensure normal running of the electrical device; when the connected AC power is cut off, the set of DC terminals are conductive between each other, and DC power connected from outside of the electrical device supplies power to the electrical device, thereby ensuring that the electrical device can still run normally after the AC power is cut off.

Embodiment I

Figure 1:
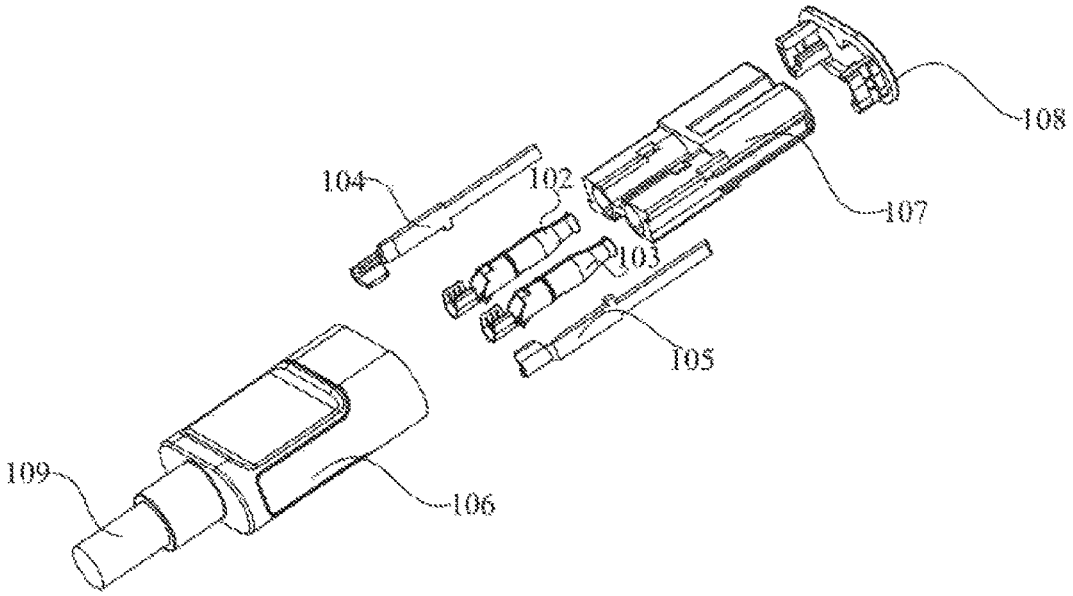
FIG. 1 is an explosive view of a power plug according to embodiment I of the present disclosure.
Figure 2:
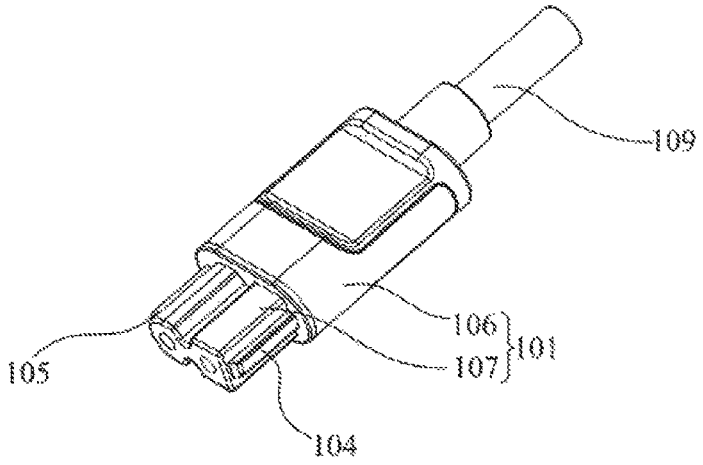
FIG. 2 is an assembly view of the power plug according to embodiment I of the present disclosure.
Figure 3:
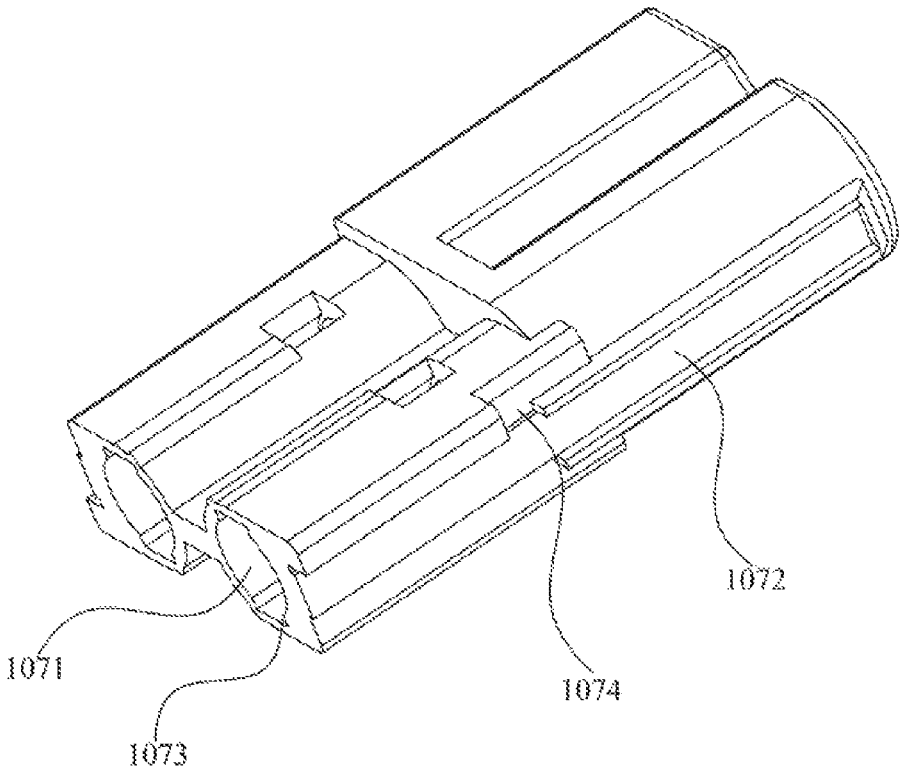
FIG. 3 is a schematic structural diagram of a second body according to embodiment I of the present disclosure.
Figure 4:
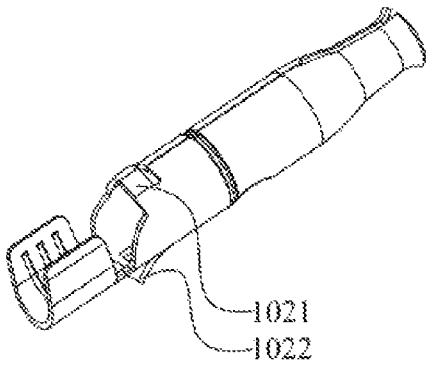
FIG. 4 is a schematic structural diagram of an L plug terminal according to embodiment I of the present disclosure.
Figure 5:
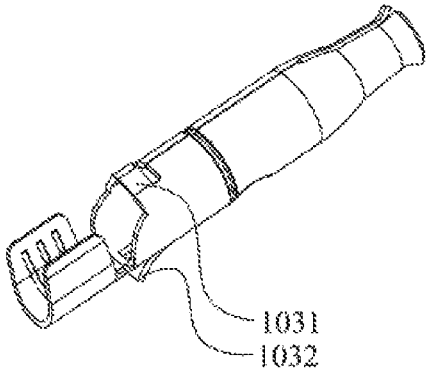
FIG. 5 is a schematic structural diagram of an N plug terminal according to embodiment I of the present disclosure.
Figure 6:
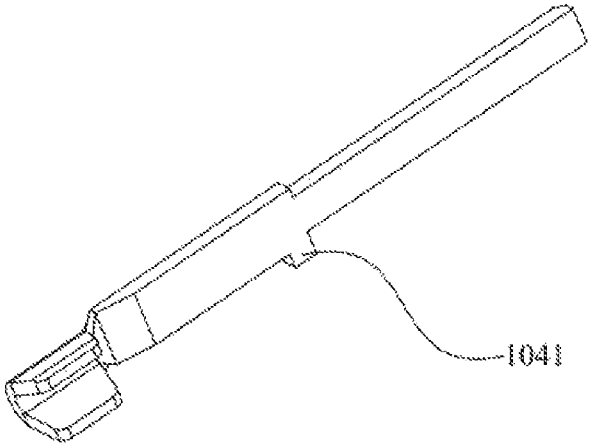
FIG. 6 is a schematic structural diagram of a positive DC plug terminal according to embodiment I of the present disclosure.
Figure 7:
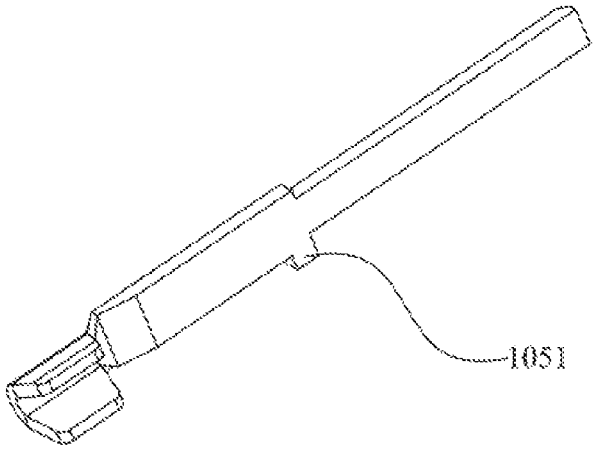
FIG. 7 is a schematic structural diagram of a negative DC plug terminal according to embodiment I of the present disclosure.
Figure 8:
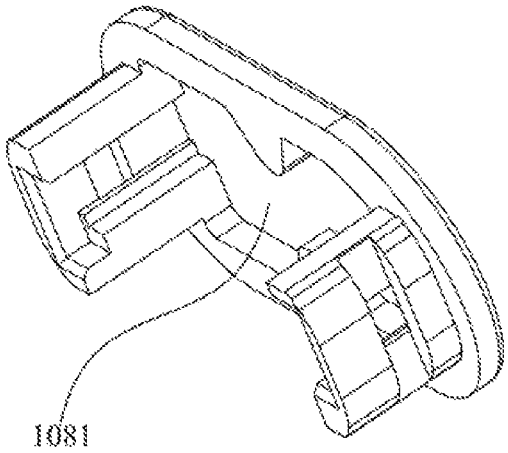
FIG. 8 is a schematic structural diagram of an end cap according to embodiment I of the present disclosure.

As illustrated in FIGS. 1 to 8, the present embodiment provides a power plug including a body 101, at least two AC plug terminals fixed inside the body 101, and two DC plug terminals fixed inside the body 101. Each of the AC plug terminals and each of the DC plug terminals are respectively connected to separate connecting wires.

The AC plug terminals may include an L plug terminal 102 and an N plug terminal 103. The DC plug terminals may include a positive DC plug terminal 104 and a negative DC plug terminal 105.

The body 101 may include a first body 106 and a second body 107 disposed inside a cavity of the first body 106. Two AC plug terminals and two DC plug terminals are fixedly connected to the second body 107. Each of the AC plug terminals and each of the DC plug terminals are respectively connected to separate connecting wires penetrating out of the first body 106. The connecting wires penetrating out of the first body 106 are cladded into one conducting wire 109. An end of the conducting wire 109 far from the AC plug terminals and the DC plug terminals is connected to an electrical device.

Two mounting holes 1071 are provided inside the second body 107. One AC plug terminal may be disposed in each of the mounting holes 1071. The AC plug terminals may include the L plug terminal 102 and the N plug terminal 103. Two opposite slots 1073 are disposed on side walls of each mounting hole 1071. Extension direction of each slot 1073 is length direction of a corresponding mounting hole 1071. The L plug terminal 102 is provided with a first flexible claw 1021 and a second flexible claw 1022 opposite to each other. The first flexible claw 1021 and the second flexible claw 1022 are flexibly joined to and pressed against with the slots 1073 so as to fix the L plug terminal 102 to the mounting hole 1071 so that the L plug terminal 102 does not slide out of the mounting hole 1071 easily. The N terminal 103 is also provided with a first flexible claw 1031 and a second flexible claw 1032 opposite to each other so that the N terminal 103 is tightly fixed into the mounting hole 1071. Material of the flexible claws may be phosphor copper. The phosphor copper is flexible and thus can make the flexible claws joined to and pressed against the slots 1073.

Moreover, at least three mounting holes 1071 may further be disposed inside the second body 107. A corresponding number of AC plug terminals may be disposed inside the mounting holes 1071. Three mounting holes 1071 may be disposed inside the second body 107. The L plug terminal 102, the N plug terminal 103 and an E plug terminal may be disposed inside the three mounting holes 1071. The L plug terminal 102 is connected to a live wire of the electrical device. The N plug terminal 103 is connected to a null line of the electrical device. The E plug terminal is connected to an earth wire of the electrical device. More than three mounting holes 1071 may be disposed inside the second body 107. Plug terminals used for an industrial electrical device may be disposed inside the mounting holes 1071 more than three.

Additionally, each of two outer side walls of the second body 107 may be provided with a mounting slot 1072. A side wall of each of the mounting slots 1072 is provided with a mounting notch 1074 that has an opening facing a first surface of the second body 107. The DC plug terminals include the positive DC plug terminal 104 and the negative DC plug terminal 105. A first protrusion 1041 is provided on the positive DC plug terminal 104. A second protrusion 1051 is provided on the negative DC plug terminal 105. By respectively clamping the first protrusion 1041 and the second protrusion 1051 to two mounting notches 1074, two DC plug terminals are respectively fixed inside two mounting slots 1072. The DC plug terminals may adopt gold-plated designs to improve electrical conductivity, corrosion resistance and abrasive resistance of the DC plug terminals.

The number of the mounting holes 1071 and the number of the mounting slots 1072 in mounting structures are not limited, and are sum up to the number of the terminals. The mounting holes 1071 and the mounting slots 1072 may also be disposed in a length direction of the body 101. Moreover, the mounting structures may also be disposed on the first body 106. The mounting structures may include stack mounting of the first body 106 and the second body 107.

An end of the L plug terminal 102, the N plug terminal 103, the positive DC plug terminal 104 and the negative DC plug terminal 105 closer to connecting wire is provided with a wire connecting portion. A wire connecting portion of the L plug terminal 102 is connected to an L wire (live wire) of the electrical device. A wire connecting portion of the N plug terminal 103 is connected to an N wire (null line) of the electrical device. A wire connecting portion of the positive DC plug terminal 104 is connected to a DC positive wire of the electrical device. A wire connecting portion of the negative DC plug terminal 105 is connected to a DC negative wire of the electrical device. Material of the wire connecting portions of the DC plug terminals and the AC plug terminals may be brass that has plasticity. Metal portions of the connecting wires are placed inside corresponding wire connecting portions and the wire connecting portions are squeezed so that the conducting wire 109 is fixed to the AC plug terminals and the DC plug terminals.

The power plug may be further provided with an end cap 108 clamped to an end of the first body 106. A communicating pore 1081 is provided on the end cap 108. An end of the second body 107 passes through the end cap 108 via the communicating pore 1081. The end cap 108 can prevent plug components disposed inside the first body 106 from falling off the first body 106 and can prevent dust and water.

Furthermore, the body 101 may be not divided into two parts including the first body 106 and the second body 107. That is, more than two mounting structures are disposed inside the body 101. The number of the mounting structures is equal to a sum of the number of the AC plug terminals and the number of the DC plug terminals. Each mounting structure may be provided with one AC plug terminal or one DC plug terminal.

Embodiment II

Figure 9:
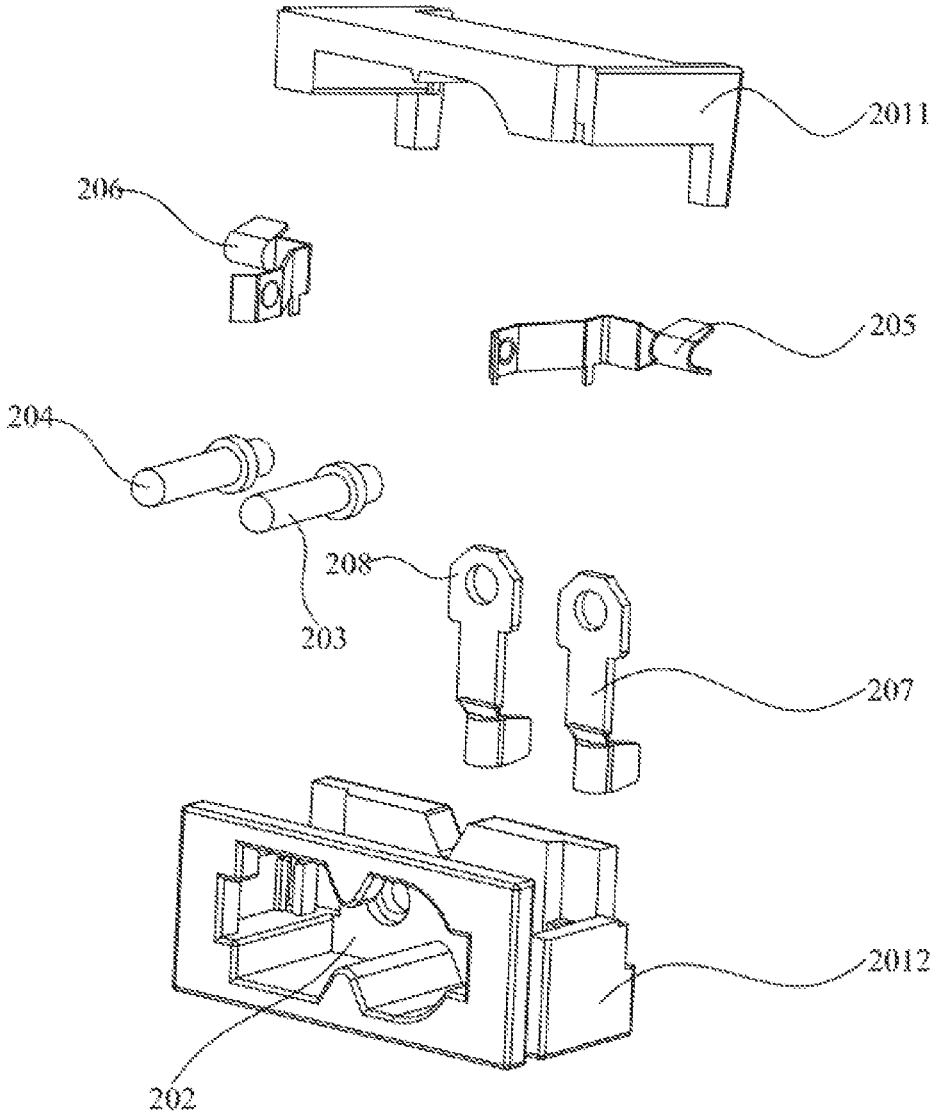
FIG. 9 is an explosive view of a power socket according to embodiment II of the present disclosure.
Figure 10:
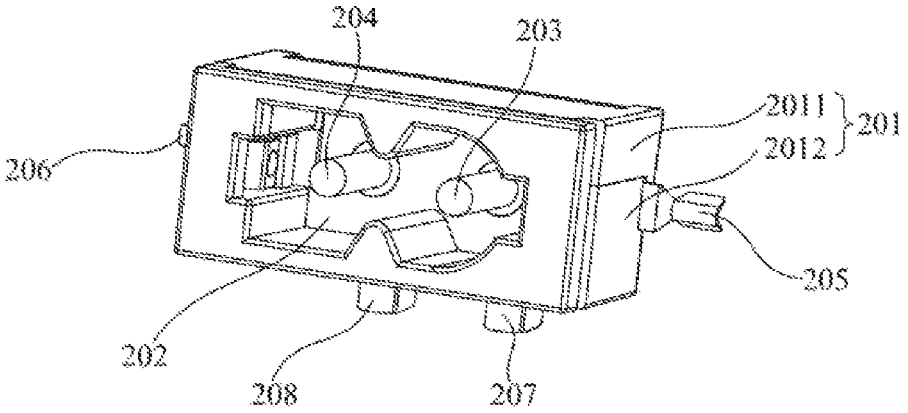
FIG. 10 is a front view of the power socket according to embodiment II of the present disclosure.
Figure 11:
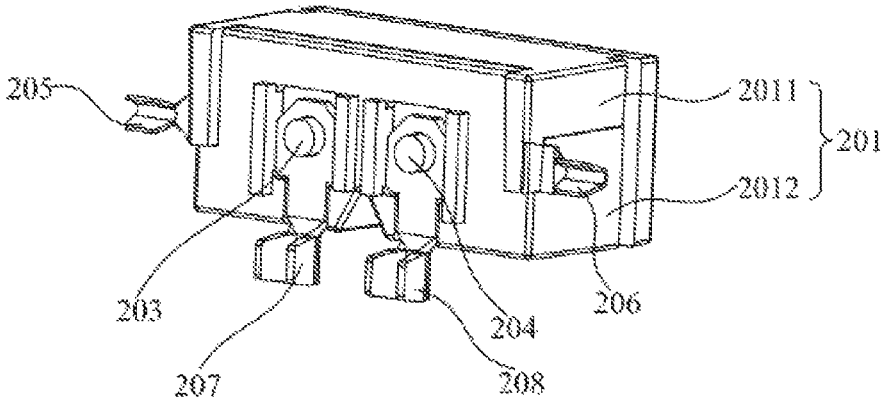
FIG. 11 is a rear view of the power socket according to embodiment II of the present disclosure.

As illustrated in FIGS. 8 to 11, the present embodiment provides an optional power socket. The power socket works together with the power plug provided by embodiment I and includes a base 201. The base 201 is provided with a base cavity 202. Shape of the base cavity 202 is adapted to shape of an insert end of the body 101. The base cavity 202 is provided with AC socket terminals corresponding to the AC plug terminals one by one and DC socket terminals corresponding to the DC plug terminals one by one. The base 201 may include an upper base cover 2011 and a lower base cover 2012 that are clamped to each other.

The power socket is provided with at least two AC socket terminals. The AC socket terminals may be connected to a two-pin plug, a three-pin plug or a multi-pin plug. As regards the socket working together with the two-pin plug, two through holes are provided on a back of the base 201 of the socket. In the two through holes, an L socket terminal 203 is fixedly disposed in a first through hole, and an N socket terminal 204 is fixedly disposed in a second through hole. A first end of the L socket terminal 203 and a first end of the N socket terminal 204 are disposed inside the base cavity 202. A second end of the L socket terminal 203 and a second end of the N socket terminal 204 extend out of the base 201. The first end of the L socket terminal 203 inside the base cavity 202 is connected to the L plug terminal 102. The second end of the L socket terminal 203 extending out of the base 201 is connected to a pole L of AC power. The first end of the N socket terminal 204 inside the base cavity 202 is connected to the N plug terminal 103. The second end of the N socket terminal 204 extending out of the base 201 is connected to a pole N of the AC power.

Each of a left side and a right side of the base 201 is clamped to a DC socket terminal by a clamping slot. A first end of each DC socket terminal is disposed inside the base cavity 202. A second end of each DC socket terminal extends out of the base 201. The DC socket terminals include a positive DC socket terminal 205 and a negative DC socket terminal 206. A first end of the positive DC socket terminal 205 inside the base cavity 202 may be connected to the positive DC plug terminal 104. A second end of the positive DC socket terminal 205 extending out of the base 201 may be connected to a positive pole of DC power. A first end of the negative DC socket terminal 206 inside the base cavity 202 may be connected to the negative DC plug terminal 105. A second end of the negative DC socket terminal 206 extending out of the base 201 may be connected to a negative pole of the DC power. The DC socket terminals may adopt gold-plated designs to improve electrical conductivity, corrosion resistance and abrasive resistance of the DC socket terminals.

Additionally, a first connecting terminal 207 may be fixed to an end of the L socket terminal 203 outside the base 201 through a screw thread connection. A second connecting terminal 208 may be fixed to an end of the N socket terminal 204 outside the base 201 through a screw thread connection. The first connecting terminal 207 is connected to a pole-L connecting wire of power and the second connecting terminal 208 is connected to a pole-N connecting wire of the power, so as to make AC power conductive.

INDUSTRIAL APPLICABILITY

In the power plug and socket provided in the present disclosure, two DC plug terminals are provided on the power plug and two DC socket terminals are provided on the power socket, and the power plug and the power socket work together with each other, so that an electrical device can still run normally after AC power is cut off.

What is claimed is:

1. A power plug, comprising:

a body;

at least two Alternating Current, AC, plug terminals fixed inside the body; and two Direct Current, DC, plug terminals fixed inside the body;

wherein each of the AC plug terminals and each of the DC plug terminals are respectively connected to separate connecting wires;

wherein the body comprises a first body and a second body, wherein the first body and the second body are adaptively joined to each other to form a plurality of mounting structures, and each of the AC plug terminals and each of the DC plug terminals are respectively fixed inside different mounting structures;

wherein a cavity is provided inside the first body and is configured to accommodate a part of the second body; and wherein the plurality of mounting structures comprise at least two mounting holes and two mounting slots; and wherein the at least two mounting holes are provided inside the second body, each of the AC plug terminals is fixed inside a respective one of the mounting holes, the two mounting slots are provided on a surface of the second body, and each of the DC plug terminals is fixed inside a respective one of the mounting slots.

2. The power plug according to claim 1, wherein slots are provided along a depth direction on hole walls of the mounting holes, a first flexible claw and a second flexible claw are provided on the AC plug terminal, and the first flexible claw and the second flexible claw are flexibly joined to and pressed against the slots respectively.

3. The power plug according to claim 1, further comprising an end cap clamped to an end of the first body, wherein a communicating pore is provided on the end cap, and an end of the second body passes through the end cap via the communicating pore.

4. The power plug according to claim 1, wherein a mounting notch is provided on a side wall of the mounting slot, and a protrusion is provided on the DC plug terminal and is clamped in the mounting notch 44074).

5. The power plug according to claim 1, further comprising an end cap clamped to an end of the first body, wherein a communicating pore is provided on the end cap, and an end of the second body passes through the end cap via the communicating pore.

6. A power plug, comprising:

a body;

at least two Alternating Current, AC, plug terminals fixed inside the body; and two Direct Current, DC, plug terminals fixed inside the body, wherein each of the AC plug terminals and each of the DC plug terminals are respectively connected to separate connecting wires;

wherein the body comprises a first body and a second body, wherein the first body and the second body are adaptively joined to each other to form a plurality of mounting structures, and each of the AC plug terminals and each of the DC plug terminals are respectively fixed inside different mounting structures;

wherein a cavity is provided inside the first body and is configured to accommodate a part of the second body; and wherein the power plug further comprises an end cap clamped to an end of the first body, wherein a communicating pore is provided on the end cap, and an end of the second body passes through the end cap via the communicating pore.

7. A power socket, which works together with a power plug and comprises a base;

wherein the power plug comprises a body; at least two Alternating Current, AC, plug terminals fixed inside the body; and two Direct Current, DC, plug terminals fixed inside the body, wherein each of the AC plug terminals and each of the DC plug terminals are respectively connected to separate connecting wires;

wherein the base is provided with a base cavity, a shape of the base cavity is adapted to a shape of an insert end of the body, and the base cavity is provided with AC socket terminals corresponding to the AC plug terminals one by one and DC socket terminals corresponding to the DC plug terminals one by one; and wherein two DC socket terminals are respectively clamped to inner side walls of the base by clamping slots, and a first end of each DC socket terminal is disposed inside the base cavity and a second end of each DC socket terminal extends out of the base.

8. The power socket according to claim 7, wherein at least two of the AC socket terminals are fixedly mounted to a back of the base, and a first end of each AC socket terminal is disposed inside the base cavity and a second end of each AC socket terminal extends out of the base.

* * * * *